United States Patent [19]

Trihey

[11] 4,416,587

[45] Nov. 22, 1983

[54] HEAT OPERATED PUMP

[75] Inventor: John M. Trihey, Bayswater, Australia

[73] Assignee: Malz Nominees Pty. Ltd., Caulfield, Australia

[21] Appl. No.: 168,770

[22] Filed: Jul. 11, 1980

Related U.S. Application Data

[62] Division of Ser. No. 940,765, Sep. 8, 1978, abandoned.

[51] Int. Cl.[3] ..... F04B 19/24

[52] U.S. Cl. ..... 417/52; 417/209

[58] Field of Search ..... 417/52, 207, 208, 209, 417/379

[56] References Cited

U.S. PATENT DOCUMENTS

| | | | |
|---|---|---|---|
| 3,937,599 | 2/1976 | Thureau et al. | 417/379 X |
| 3,986,360 | 10/1976 | Hagen | 417/379 X |
| 4,227,866 | 10/1980 | Stubbs | 417/379 |

*Primary Examiner*—Richard E. Gluck

[57] ABSTRACT

A pump comprising a pump chamber having an inlet and an outlet, pumping means disposed within the chamber, the pumping means being temperature sensitive and having a first stable position when at a first temperature and a second stable condition when at a second temperature, and means operable to alternately change the temperature of the pumping means from its first to its second temperature whereby fluid within the chamber is pumped out of the outlet by the movement of the pumping means between the first and second stable positions.

3 Claims, 7 Drawing Figures

HEAT OPERATED PUMP

This is a division of application Ser. No. 940,765, filed Sept. 8, 1978, now abandoned.

This invention relates to fluid operated machines, particularly pumps.

In certain applications for pumps it is difficult to supply motive power to the pumps for their operation. For instance, in pumping water from artesian bores in isolated regions, it is usually necessary to rely upon wind as a source of power for the pumps. There are drawbacks associated with deriving power from the wind such as difficulties in erection and maintenance of windmills in isolated locations. Further the output is unpredictable since it is subject to prevailing wind conditions. In other applications it is desirable to have a completely self-contained pumping station which is not dependent upon motive power from external sources. For instance, in solar heating apparatus it is desirable that the pump pumping the heated fluid be independent of external sources of power such as electrical supplies for fuel consuming motors.

A first object of the invention is to provide pumps which will operate to pump a fluid without the need to supply external motive power to the pump which instead rely upon heat energy supplied to the pump or to the fluid to be pumped. A second object is to provide a fluid operated motor which operates in conjunction with fluids at different temperatures.

According to the present invention there is provided a pump comprising a pump chamber having an inlet and an outlet, pumping means disposed within the chamber, the pumping means being temperature sensitive and having a first stable position when at a first temperature and a second stable condition when at a second temperature, and means operable to alternately change the temperature of the pumping means from its first to its second temperature whereby fluid within the chamber is pumped out of the outlet by the movement of the pumping means between the first and second stable positions.

Where supplies of fluid at different temperatures are available, said means operable to alternately change the temperature of the pumping means may comprise valve means arranged to alternately admit fluid at first one temperature and then the other to effect reciprocation of the pumping means and thereby effect pumping of the fluid admitted to the chamber.

Alternatively, said means operable to alternately change the temperature of the pumping means may include heat transfer means to supply heat energy to or extract heat energy from the pumping means to thereby cause it to move between its first and second stable states and, thus, to pump fluid in the chamber. In one arrangement of this type, the heat transfer means may comprise a heat absorbing surface, which may, for instance, be arranged to be heated by concentrated solar energy, and which transfers heat to fluid within the chamber so that the fluid is heated which, in turn, heats the pumping means to effect pumping.

In one arrangement the pumping means may include an expansible body containing a volatile fluid which evaporates at said first temperature and condenses at said second temperature whereby resultant pressure differences within the body cause it to assume positions corresponding to said first and second stable positions. For instance, the body may comprise a piston and cylinder assembly, movement of the piston being used to effect a pumping action upon fluid in the pumping chamber.

In an alternative arrangement the pumping means may comprise a buckling diaphragm.

The invention will now be further described with reference to the accompanying drawings, in which.

Figure 1:
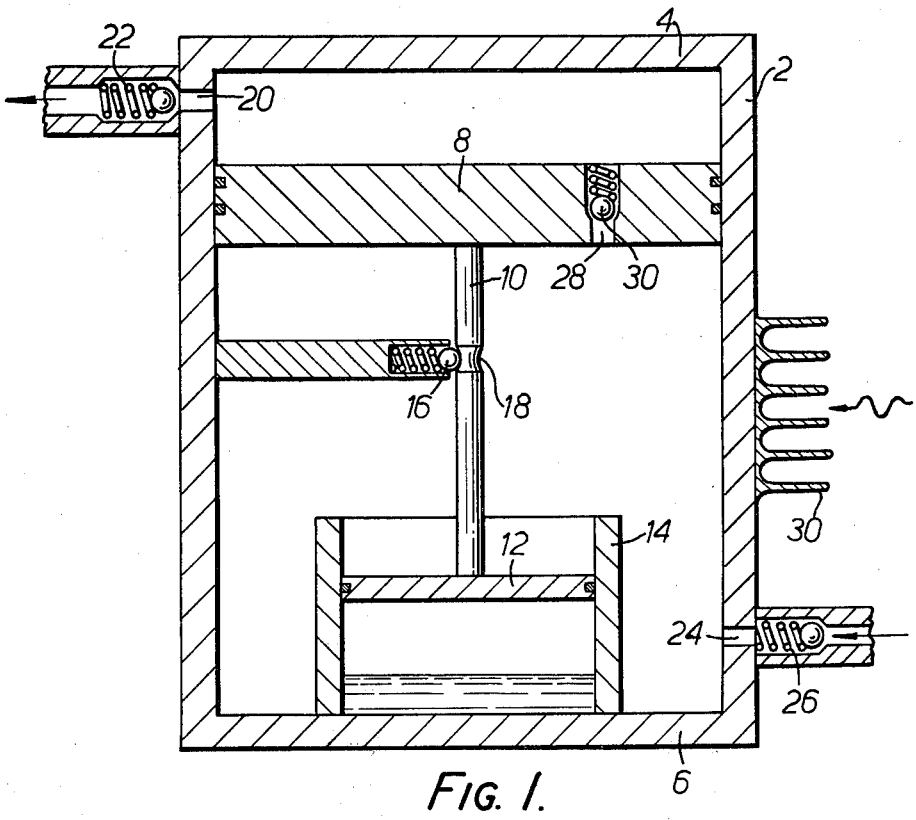
FIG. 1 is a cross-sectional veiw through one form of pump in accordance with the invention.

The pump shown in FIG. 1 comprises a hollow cylinder 2 having its top and bottom closed by end walls 4 and 6. Mounted within the cylinder 2 is a piston 8 the periphery of which sealingly engages the inner surface of the cylinder 2. The upper end of a piston rod 10 is connected to the lower side of the piston 8. The lower end of the rod 10 is connected to a secondary piston 12 which is mounted for movement within a second cylinder 14 which is affixed to the bottom wall 6. The space between the piston 12 and the bottom wall 6 and within the secondary cylinder 14 is partly filled with a volatile liquid, for instance freon.

When the volatile liquid within the secondary cylinder 14 is heated, it wil vaporize and increase the pressure beneath the piston 12 and tend to move the latter upwards. Upward movement of the piston 12 is however restrained by a ball 16 which is resiliently biased into a groove 18 formed in the piston rod 10. When however the pressure beneath the piston 12 increases sufficiently to override the restraint of the ball 16, the piston 12 and piston rod 10 will move quickly upwardly. The piston 8, being connected to the piston rod 10, will also move quickly upwardly and it is the upward movement of the piston 8 which is the effective pumping stroke of the pump.

The cycle of operation of the pump will now be described. Assume that fluid to be pumped occupys the spaces within the cylinder 2 above and below the piston 8. Heat is now applied to the volatile liquid beneath the piston 12 so that the pressure beneath the piston 12 increases until the ball 16 releases from the groove 18 and the piston 8 moves upwardly. Upward movement of the piston 8 causes fluid above it to be ejected from an outlet port 20 which is normally held closed by a spring biased ball valve 22. Upward movement of the piston 2 will also cause fluid to be admitted to the cylinder 2 beneath the piston 8 through an inlet port 24 which is normally held closed by a second spring biased ball valve 26. The fluid admitted through the inlet port 24 cools the volatile liquid within the cylinder 14 so that the piston 12 moves downwardly to a positionn in which the ball 16 is once again in the groove 18. A return spring (not shown) may be provided to assist in the return of the pistons 12 and 8.

During downward movement of the piston 8, fluid beneath the piston 8 is transferred to the space above the piston through a transfer duct 28 which is normally closed by a biased ball valve 30. At this stage, both the inlet and outlet valves 22 and 26 are closed.

Heat may be applied directly to the lower end 6 of the cylinder so that heat is quickly transferred to the volatile liquid within the secondary cylinder 14. In such an arrangement, the fluid to be pumped is not significantly heated.

In the illustrated arrangement however the cylinder 2 has heat absorbing fins 30 affixed thereto for absorbing solar energy concentrated thereon by a parabolic reflector or lens (not shown). The fluid within the cylinder 2 and beneath the piston 8 has heat transferred thereto through the cylinder 2. The fluid is in contact with the second cylinder 14 and thus the volatile liquid is heated to effect operation of the pump.

The pump is particularly advantageous for circulating a heat transfer fluid in a solar heating apparatus; firstly, because no external source of motive power is required; and secondly, the rate of pumping of the heat transfer fluid is directly dependent upon the rate of solar heat absorbed by the fluid. Thus, the pump has an inherent capacity to regulate the temperature of the fluid issuing from the pump.

In a modified arrangement the piston 8 could be replaced by a buckling diaphragm (i.e. a resilient diaphragm, the centre of which is stressed so that it exhibits the "oil-can" effect) which is fixed at its periphery to the cylinder 2. In such an arrangement the duct 28 and valve 30 are advantageously provided in a by-pass pipe which is exterior of the cylinder 2 and interconnects the parts of the cylinder above and below the buckling diaphragm. In operation, the rod 10 is subject to forces applied by the piston 12 and is connected to the centre of the diaphragm causes the latter to quickly snap from one of its stable positions to the other and thereby effect pumping in an analogous manner to that described previously. Since the control rod 10 controls movement of the buckling diaphragm, pumping is subject to the temperature of the volatile liquid within the cylinder 14.

In a still further modified arrangement the piston 12 could be replaced by a buckling diaphragm affixed to the cylinder 14 and be caused to buckle directly in accordance with the pressure within the cylinder 14. This modification would be better suited to the pump illustrated in FIG. 1 than that described immediately above although the latter would still be workable.

Figure 2:
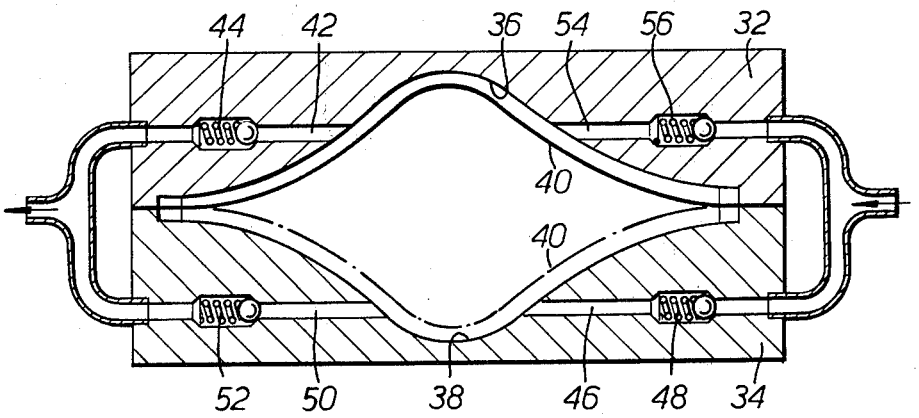
FIG. 2 is a second form of pump constructed in accordance with the invention.

FIG. 2 shows a modified form of pump in accordance with the invention. This pump comprises upper and lower disc-shaped body parts 32 and 34 which have complementary recesses 36 and 38 which together define a pumping chamber. Mounted between the disc members 32 and 34 is a buckling diaphragm 40. The diaphragm 40 is composed of by bi-metallic material so that it assumes the position shown in full lines when relatively hot and the position shown in broken lines when relatively cold. The operation of the pump is as follows: assume that the diaphragm is in the position shown in broken lines and that the space between it and the recess 36 is filled with fluid at a relatively low temperature. Heat is now transferred to the fluid; for instance, by means of solar energy concentrated upon the disc members 32 and 34, but preferably only upon member 34 so that the temperature of the fluid will rise to a point at which the buckling diaphragm 40 becomes unstable and buckles to its high temperature position in the full lines. When the diaphragm 40 buckles in this way fluid above it will be forced to flow through an upper outlet duct 42 which is normally closed by a spring biased ball valve 44. Simultaneously, fluid will be admitted to the pumping chamber beneath the diaphragm 40 through a lower inlet duct 46 which is normally closed by a spring biased ball valve 48. The sudden introduction of relatively cold fluid beneath the diaphragm 40 will cause it to buckle to its cold position as shown in broken lines. With the return of the diaphragm to its cold position, fluid between it and the recesses 38 will be forced to issue from a lower outlet duct 50 which is normally held closed by a spring biased ball valve 52. Simultaneously, further fluid will be admitted to the pumping chamber between the diaphragm 40 and the recess 36 through an upper inlet duct 54 which is normally held closed by a spring biased ball valve 56. The pump will remain in this position until the fluid between the diaphragm 40 and the recess 36 reaches the temperature at which the buckling diaphragm buckles to its hot position once again. In the illustrated arrangement the lower outlet duct 50 is shown as being connected to the upper outlet duct 42 but in some arrangements, particularly where the pump is used to circulate a heat transfer fluid in a solar heating apparatus, the duct 50 may be returned to the inlet side so that the pump only effectively pumps hot fluid, or alternatively a by-pass valve could be provided through the diaphragm.

Figure 3:
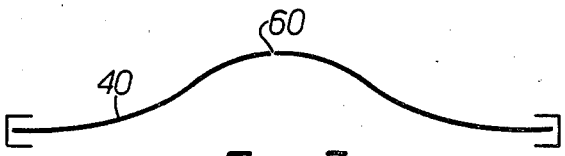
FIGS. 3 and 4 show bleed parts which may be included in the diaphragm of the pump shown in FIG. 2
Figure 4:
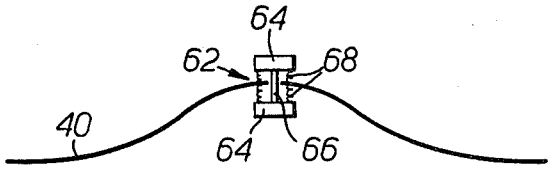

In some circumstances, particularly where the temperature of the hot fluid being expelled is not a good deal hotter than the cool liquid being admitted, the cooling effect of the cool liquid being admitted may cool the diaphragm sufficiently to prevent it from buckling to its hot stable position and thus prevent the pump from working. In such circumstances it is necessary to provide means to prevent inflow of cool liquid until immediately before the buckling diaphragm is ready to snap to its hot stable position. FIG. 3 shows one arrangement for accomplishing this object. In this arrangement, the diaphragm 40 includes a bleed orifice 60 through which fluid can pass when the diaphragm 40 is moving relatively slowly i.e. whilst moving under influence of its bi-metallic action. Once the diaphragm reaches its centre position it is unstable and will then quickly snap to either the hot or cold stable position. During the snapping movement, the prestresing of the diaphragm is dominant and consequently the movement is very rapid, and therefore little fluid can pass through the bleed orifice. Thus pumping and admission of cool fluid only takes place during periods of snapping movement of the diaphragm. A similar effect could be achieved by a narow guage by-pass tube extending exteriorly of the body parts 32 and 34 interconnecting both sides of the pumping chamber. FIG. 4 shows an arrangement for preventing any flow of fluid through the bleed orifice 60 during periods of snapping movement. In this arrangement a double sided flap valve 62 is mounted in the orifice 60. The valve 62 comprises a pair of sealing members 64 of relatively high mass interconnected by a rod 66. A pair of light compression springs 68 surround the rod 66 and act between the diaphragm 40 and respective sealing members 64. This valve will permit flow through the orifice 40 when the diaphragm is moving slowly; when however the diaphragm moves quickly, one or other of the sealing members 64 will engage the diaphragm 40 and block the orifice.

Figure 5:
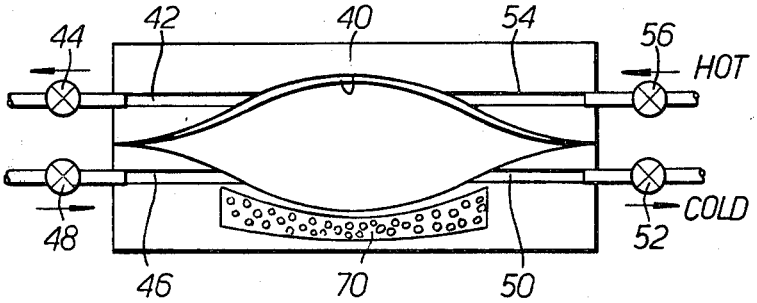
FIGS. 5 and 6 show modified pumps which operate on an analogous principle to that shown in FIG. 2.

FIG. 5 illustrates a form of pump which is particularly suitable for pumping circulating fluid in central heating systems. In this arrangement hot fluid, usually water, from a boiler enters the pump through the valve 56 and leaves via valve 44. From the valve 44, the hot water is pumped to various heating appliances which absorb heat from the water and thus cool it. Cool water from the appliances is returned to the pump via the valve 48 and leaves via the valve 52 to be heated again in the boiler. The pump may include an electric heating coil 70 to heat fluid in the pump to enable the pump to commence pumping. Alternatively the pump could be started by the use of flue gases from the boiler, rather than the coil 70.

Figure 6:
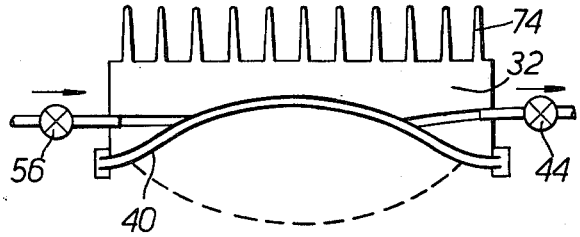

FIG. 6 illustrates an arrangment which is suitable for pumping fluid which is at a different temperature to the surrounding atmosphere; for example, pumping of water from artesian bores. In such an arrangement the body portion 32 includes cooling fins 74 so that hot artesian water drawn into the pumping chamber will be cooled, thereby achieving the necessary periodic temperature changes for pumping.

Figure 7:
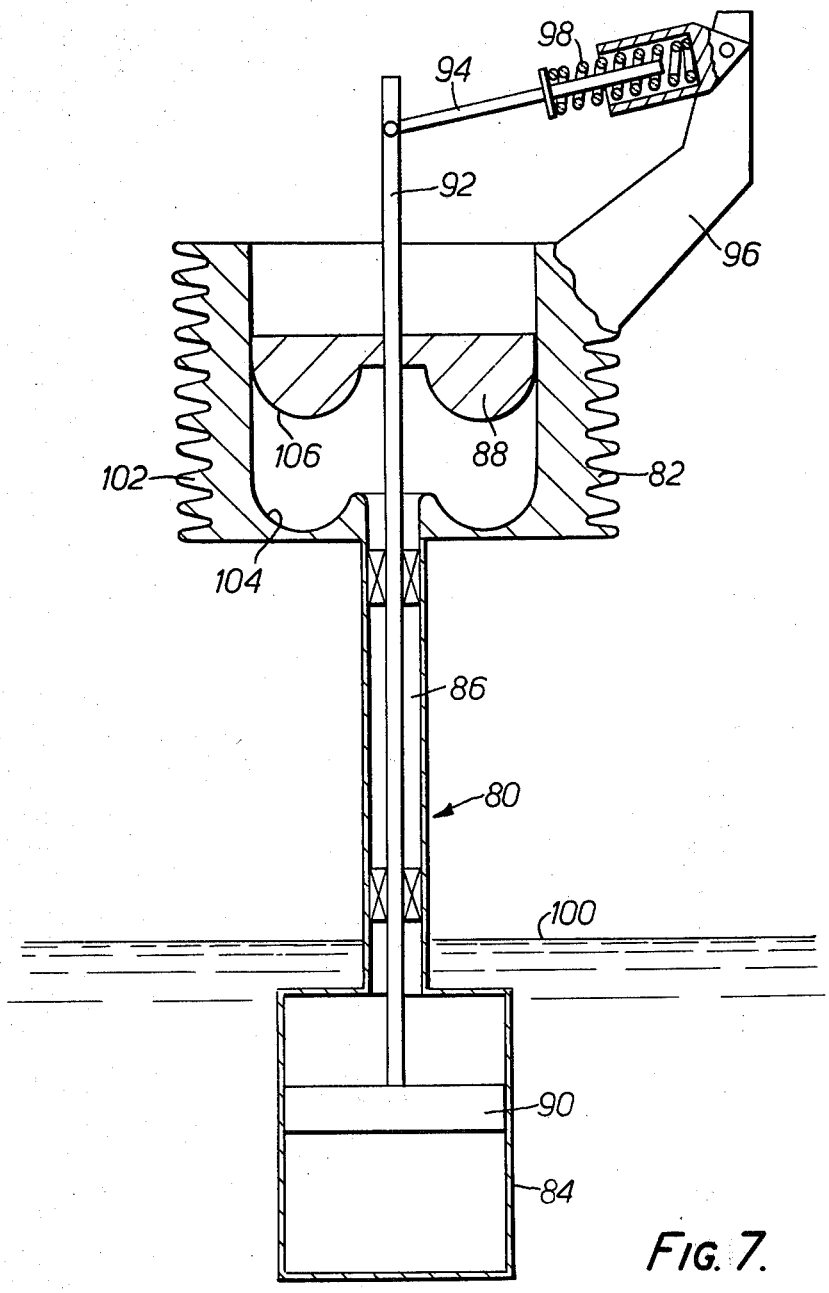
FIG. 7 is a cross sectional view of a fluid motor which operates on the same principles as the pump of the present invention.

FIG. 7 illustrates a fluid motor which operates on generally the same principles as the pump of the invention.

In accordance with this aspect there is provided a fluid motor comprising a chamber having a heat first portion containing a liquid and a second portion which is cylindrical in shape, the motor including a piston mounted for movement within the second portion of the chamber, the second chamber including a fluid reservoir for receiving fluid which has condensed on the cylindrical walls beneath said piston and biasing means for biasing the piston towards said reservoir. In operation the first portion has heat applied thereto, say be immersion in a hot fluid causing the liquid to vapourize. The increased pressure in the chamber causes the piston to rise against the action of the biasing means. It is preferred that the biasing means are non linear in that they initially provide high resistance to movement but once movement has begun offer reduced resistance thereby ensuring that the piston stroke is fast and takes place only after significant pressure has developed in the chamber. After upward movement of the piston, vapourized liquid fills the second portion of the chamber which is arranged to be relatively cool so that the liquid condenses and collects in the fluid reservoir. As condensation continues the pressure will finally drop and the piston will move downwardly under the influence of the biasing means, which because of its non-linear nature, becomes more significant as downward movement continues. At the bottom of its stroke the piston is arranged to displace the liquid in the reservoir and return it to the first portion of the chamber in readiness for the next cycle of operation.

The arrangement shown in FIG. 7 comprises a chamber 80 having upper and lower cylindrical portions 82 and 84, the former of greater diameter than the latter, and the two portions being connected by a straight passage 86. Pistons 88 and 90 are mounted in the portions 82 and 84 respectively. A piston rod 92 interconnects both pistons and extends through the passage 86 and beyond the upper portion 82. A rod 94 is pivotally connected near the upper end of the piston rod 92 and extends generally transversely thereto. A support arm 96 extends upwardly from the portion 82 and serves as a support base for a compression spring 98 which biases the rod 94 towards the piston rod 92. The arrangment is such that the rod 94 is almost normal to the rod 92 when the piston 88 is near the top of its stroke, so that upward movement of the rod 92 when near the top of the stroke encounters little resistance from the spring. On the other hand, when near the bottom of its stroke relatively small movement of the rod 92 generate longer compressions of the opening and thus more resistance is encountered.

The lower chamber 84 is charged with a volatile liquid such as FREON and is arranged to be heated say by immersion into a body 100 of hot liquid so as to cause evaporation of the FREON. The pressure builds up within the chamber until it reaches such a level as to overcome the bias applied by the spring 98, whereupon the pistons move quickly upwardly to the top of their stroke. FREON vapour will enter the upper chamber and will condensate upon the inner side walls of the chamber, cooling fins 102 being provided on its exterior surface. Condensed FREON collects in a reservoir 104 at the bottom of the upper chamber 82.

Condensation of FREON causes the pressure within the chamber to drop to the point where the pistons are returned to their initial position under the influence of the spring 98. The underside surface 106 of the piston 88 is made complementary in configuration to the reservoir 104 so as to displace the condensed liquid therein on the down stroke of the piston and return the condensed liquid to the first chamber 84. This cycle will continue as long as long as heat is available to the lower chamber 84 and cooling is available at the upper chamber 82. Work output may be extracted from the piston rod 92 for driving pumps or any other device requiring mechanical power.

Many modifications will be apparent to those skilled in the art without departing from the spirit and scope of the invention.

I claim:

1. A transducer for converting heat energy of a fluid into kinetic energy, said transducer comprising:

(a) cylinder means and at least one piston slidably mounted therein;

(b) a volatile fluid contained within the cylinder means;

(c) a pump, said pump including a pump chamber, a pumping element movable therein, inlet and outlet means for admitting and discharging said fluid from the pumping chamber, said piston and said cylinder means being located within said pump chamber whereby said piston is connected to said pump;

(d) non-linear restraining means which acts on said piston and is operable to hold said at least one piston in a first stable position (e) means to apply heat energy to said volatile fluid, whereupon said volatile fluid evaporates to exert increased pressure on said at least one piston sufficient to overcome said restraining means, and said at least one piston moves to a second stable position at which the restraining force applied to said at least one piston by said non-linear restraining means is less than at said first stable position.

2. A transducer for converting heat energy of a fluid into kinetic energy, said transducer comprising:

(a) cylinder means and at least one piston slidably mounted therein;

(b) a volatile fluid contained within the cylinder means;

(c) a pump, said pump including a pump chamber comprising a cylindrical body, inlet and outlet means for admitting and discharging said fluid from said pump chamber, and a pump piston slidably mounted in said cylindrical body, said pump piston including a check valve for permitting said fluid to flow from the inlet side of the pump piston to the outlet side but not in the reverse direction, said cylinder means and said at least one piston being located within said clyindrical body on the inlet side of said pump piston;

(d) non-linear restraining means which acts on said piston and is operable to hold said at least one piston in a first stable position;

(e) means to apply heat energy to said volatile fluid, whereupon said volatile fluid evaporates to exert increased pressure on said at least one piston sufficient to overcome and restraining means, and said at least one piston moves to a second stable position at which the restraining force applied to said at least one piston by said non-linear restraining means is less than at said first stable position.

3. A transducer for converting heat energy of a fluid into kinetic energy, said transducer comprising:

(a) cylinder means and at least one piston slidably mounted therein;

(b) a volatile fluid contained within the cylinder means;

(c) a pump, said pump including a pump chamber comprising a cylindrical body, inlet and outlet means for admitting and discharging said fluid from said pump chamber, and a pump piston slidably mounted in said cylindrical body, said pump piston including a check valve for permitting said fluid to flow from the inlet side of the pump piston to the outlet side but not in the reverse direction, said cylinder means and said at least one piston being located within said cylindrical body on the inlet side of said pump piston;

(d) a connecting rod, said connecting rod connecting said at least one piston to said pump and defining a depression in its surface;

(e) non-linear restraining means which acts on said piston and is operable to hold said at least one piston in a first stable position, sand non-linear means including a resiliently biased member which engages said rod and enters said depression when said at least one piston is at said first stable position;

(f) means to apply heat energy to said volatile fluid, whereupon said volatile fluid evaporates to exert increased pressure on said at least one piston sufficient to overcome said restraining means, and said at least one piston moves to a second stable position at which the restraining force applied to said at least one piston by said non-linear restraining means is less than at said first stable position.

* * * * *